313-422 SR
5/19/87 XR 4,667,130

United States Patent [19]
Geffcken

[11] Patent Number: 4,667,130
[45] Date of Patent: May 19, 1987

[54] FLAT GAS DISCHARGE DISPLAY

[75] Inventor: Walter Geffcken, Munich, Fed. Rep. of Germany

[73] Assignee: Siemens Aktiengesellschaft, Berlin and Munich, Fed. Rep. of Germany

[21] Appl. No.: 701,560

[22] Filed: Feb. 14, 1985

[30] Foreign Application Priority Data

Feb. 21, 1984 [DE] Fed. Rep. of Germany ..... 3406252

[51] Int. Cl.[4] ..... G09G 3/10
[52] U.S. Cl. ..... 315/169.4; 313/386; 313/422; 315/169.1
[58] Field of Search ..... 315/169.1, 169.3, 169.4; 313/585, 586, 422, 385, 386

[56] References Cited

U.S. PATENT DOCUMENTS

| | | | |
|---|---|---|---|
| 3,771,008 | 11/1973 | Chen et al. | 313/585 |
| 3,882,342 | 5/1975 | Kamegaya et al. | 313/585 |
| 4,112,329 | 9/1978 | Veith | 313/585 |
| 4,356,427 | 10/1982 | Noguchi et al. | 315/169.3 |
| 4,388,550 | 6/1983 | De Vries | 313/585 |
| 4,564,790 | 1/1986 | Veith | 315/169.4 |

*Primary Examiner*—Saxfield Chatmon
*Attorney, Agent, or Firm*—Herbert L. Lerner; Laurence A. Greenberg

[57] ABSTRACT

A flat gas discharge display includes a gas-filled envelope having mutually parallel front and rear wall plates disposed one behind the other as seen in a given viewing direction, at least one relatively large area cathode disposed on the front side of the rear wall plate, a cathodoluminescent layer and an anode disposed on the rear side of the front wall plate, a control unit disposed between the wall plates including front, central and rear grid electrodes each formed of a group of mutually parallel strip conductors, the strip conductors of the central grid electrode being column conductors, the strip conductors of the rear grid electrode being row conductors forming an orthogonal matrix together with the column conductors, and the strip conductors of the front grid electrode being tetrode conductors extended parallel to the row conductors and crossing the column conductors at given locations, the control unit being perforated with canals at the given locations where the tetrode conductors and column conductors cross each other, the row conductors each including n adjacent rows of channels, where n is an integer greater than one, and pairs of directly adjacent tetrode conductors disposed in front of different row conductors being combined to form a single strip conductor.

7 Claims, 3 Drawing Figures

II 1
2
3
4
5
6
7
8
9
10
11
12
13
14
15
16
17
II

FLAT GAS DISCHARGE DISPLAY

The invention relates to a flat gas discharge display.

Such devices used heretofore could not be conveniently contacted or addressed, the electron beam was not neatly guided, they required high switching voltages and had more picture lines than row and tetrode conductors.

It is accordingly an object of the invention to provide a flat gas discharge display which overcomes the hereinafore-mentioned disadvantages of the heretofore-known devices of this general type, and which can be conveniently contacted and addressed, which assures that the electron beam is guided neatly without high switching voltages and in addition, has fewer row conductors and tetrode conductors than picture lines.

With the foregoing and other objects in view there is provided, in accordance with the invention, a flat gas discharge display, comprising a gas-filled envelope having mutually parallel front and rear wall plates disposed one behind the other as seen in a given viewing direction, at least one relatively larger area cathode disposed on the front side of the rear wall plate, a cathodoluminescent layer and an anode disposed on the rear side of the front wall plate, a control unit disposed between the wall plates including front, central and rear grid electrodes each formed of a group of mutually parallel strip conductors, the strip conductors of the central grid electrode being column conductors, the strip conductors of the rear grid electrode being row conductors forming an orthogonal matrix together with the column conductors, and the strip conductors of the front grid electrode being tetrode conductors extended to the row conductors and crossing the column conductors at given locations, the control unit being perforated with canals at the given locations where the tetrode conductors and column conductors cross each other, the row conductors each including n adjacent rows of channels, where n is an integer greater than one, and pairs of directly adjacent tetrode conductors disposed in front of different row conductors being combined to form a single strip conductor.

In the flat picture tube of the instant application, electrons of a backward plasma arrive through selected holes of a control strcture at a front space, at that location they absorb energies of several kV and finally generate light dots on a fluorescent screen. The control structure contains grid electrodes in at least three planes: a control matrix of row conductors and column conductors placed in front of the row conductors as well as tetrode conductors which are in front of the matrix and extend parallel to the row conductors. The entire structure is perforated at the crossings of the column and tetrode conductors; each perforation corresponds to a picture element. The row conductors have excess width: they each are formed of n adjacent rows of holes, wherein n is an integer or whole number greater than one and serve for selecting a given group of picture lines. The selection from this group is then accomplished by the tetrode conductors which are electrically connected to their n-th neighbors.

Such an electrode configuration requires relatively few contacts, saves wideband drivers and permits a relatively coarse line raster which can be etched without special effort even if the picture element density is high. However, the manufacturing costs would be even lower if the column and/or tetrode conductors could also be made with a coarser raster. This is possible if, in accordance with U.S. application Ser. No. 549,579, the electrons were allowed to scan several picture elements in the column and/or row direction on their post-acceleration path. However, this theoretical concept cannot always be smoothly translated into practice, as experience has shown. Thus, the deflection requires large voltage excursions especially if the picture element spacings are large, and careful attention must be given to ensure that the beam cross sections are not deformed excessively. In addition, the deflection electrodes must be separated from each other above the holes of their substrate and not between them, which presents etching problems.

The advantages of the invention come to bear particularly if n has the value 2, i.e., the row conductors each are two picture lines wide, since in this case the tetrode conductors have the same width (they are only offset relative to the line conductors by one picture line), and can be equally exactly structured, given the same care. In addition, the driving conceivably becomes simple: for writing the picture line-by-line, the rows are addressed sequentially for two picture line periods; the associated information signals are given to the column conductors during each picture line period; and the tetrode conductors are advanced in the same rhythm as the row conductors, but shifted by one picture line period. The cost of the circuit and contacting could be reduced still further, if required, by combining the row conductors and/or the tetrode conductors in groups (in this connection see German Published, Non-Prosecuted application Ser. Nos. DE-OS 32 07 685 and 32 11 507, corresponding to U.S. applications Ser. Nos. 470,702 and 479,206, respectively.

In accordance with another feature of the invention, lands of the row conductors are removed or the row conducotors have openings formed therein between the channels lying side by side and parallel to the column conductors.

In accordance with a further feature of the invention, each row conductor is electrically connected to the $0^{th}$ conductor adjacent thereto, where 0 is an integer greater than 1.

In accordance with an added feature of the invention, each tetrode conductor is electrically connected to the $p^{th}$ conductor adjacent thereto, where p is an integer greater than 1.

In accordance with an additional feature of the invention, $n=2$.

In accordance with a concomitant feature of the invention, for writing-in a picture line by line, the row conductors are keyed sequentially for two picture line periods, the column conductors are provided with corresponding picture information signals during each picture line period, and the tetrode conductors are addressed sequentially in the rhythm of the row conductor keying and are shifted by one picture line period.

Other features which are considered as characteristic for the invention are set forth in the appended claims.

Although the invention is illustrated and described herein as embodied in a flat gas discharge display, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
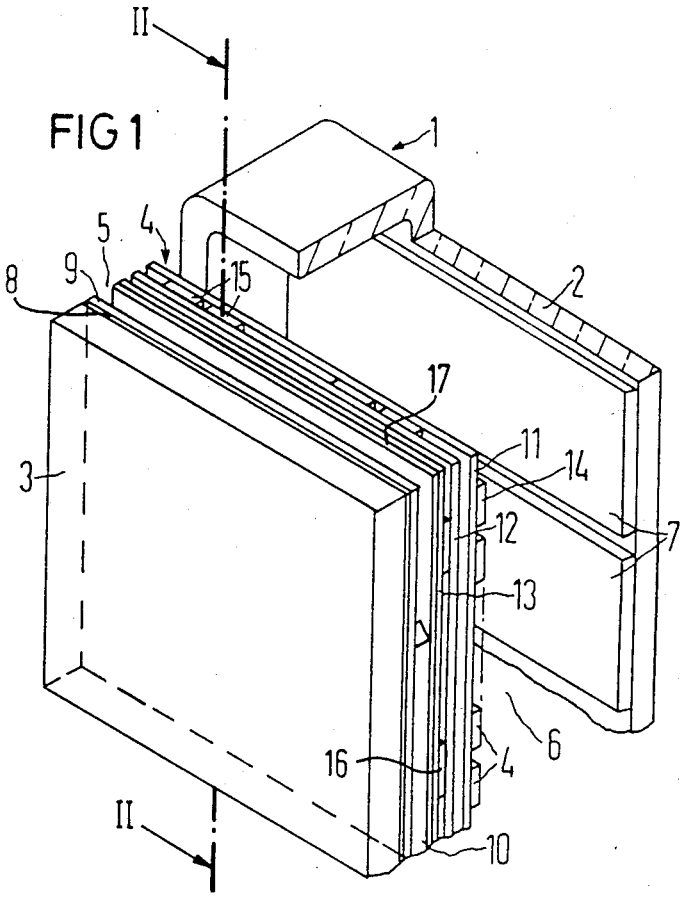
FIG. 1 is a fragmentary, diagrammatic, perspective view of a first embodiment of a display according to the invention.

Referring now to the figures of the drawings in detail and first particularly to FIG. 1 thereof, there is seen a flat picture screen provided for displaying black and white pictures. More specifically, the screen contains a gas-filled envelope 1 with a back plate 2, a front plate 3 and a control structure 4. All three parts lie in mutually parallel planes, the control structure dividing the interior of the envelope into two spaces, namely a post-acceleration space 5 in front and a gas discharge space 6 in the back.

A group of mutually-parallel cathode strips 7 with a relatively large area are disposed on the front of the back plate 2. The back of the front plate 3 carries a phosphor layer 8 which can be excited by electrons to emit light, and a post-acceleration anode 9 covering the entire area on top of the phosphor layer 8.

The control structure 4 which is braced against the front plate by a spacer frame 10, comprises three plates, namely a control plate 11 in the back, a spacer plate 12 disposed in front of the control plate 11, and a front control plate 13 placed in front of the spacer plate. A group of mutually parallel, individually addressable conductors are provided on each respective side of the control plate 11. Row conductors 14 disposed on the rear side of the control plate 11 run parallel to the cathode strips 7 and column conductors 15 on the front side of the control plate 11 extend perpendicular thereto. The control plate 13 carries tetrode conductors 16 on the rear side thereof, which run parallel to the row conductors and a continuous screen electrode 17 on the front side thereof. The entire structure has passage channels or canals 18 where the tetrode conductors 16 cross the column conductors 15. Each of these canals corresponds to a picture element.

Figure 2:
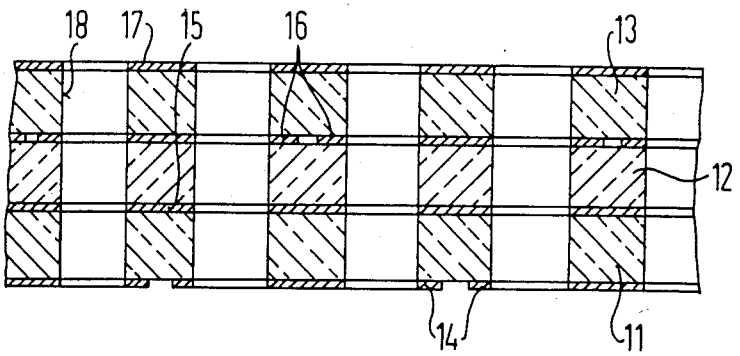
FIG. 2 is a cross-sectional view of the control structure of the embodiment of FIG. 1 taken along the line II—II in FIG. 1 along the direction of the arrows.

As can best be seen from FIG. 2, the row and tetrode conductors each cover two rows of holes and are each shifted relative to each other by one row of holes. It can also be seen in FIG. 2 that each two adjacent tetrode conductors 16 in front of row conductors 14 are combined to form a single strip conductor.

During the operation of the tube, the following voltages are present at the individual electrodes: −200 V and 0 volts, respectively, at the selected and the non-selected cathode strips; +30 V and +1O V, respectively, at the keyed and non-keyed row conductors; between 0 volts and +50 V, respectively, at the column conductors; forward or cut-off voltages of −30 V and +40 V, respectively, at the tetrode conductors; a fixed potential of +100 V at the screen electrode; and +4 kV at the post-acceleration anode. The row conductors are keyed sequentially, i.e., they are successively raised to the voltage zero volts. The cathode voltages are synchronized with the line scanning voltage in such a manner that a plasma burns between the selected row conductor and the cathode strip which happens to be located opposite it, when the rows are advanced. During the time in which a given row conductor is keyed-on, the column conductors sequentially obtain the information signals of two picture lines; each row conductor scanning time therefore includes two picture line periods. The tetrode conductors are advanced in the rhythm of the row conductor scanning, the tetrode conductor pulses lagging behind the row conductor pulses by one picture line period.

Figure 3:
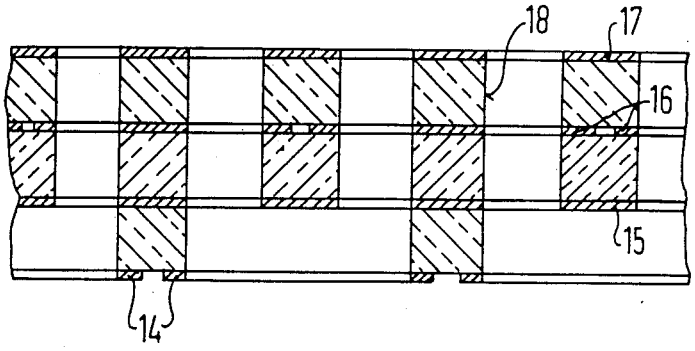
FIG. 3 is a view similar to FIG. 2 of the control structure of a further embodiment of the invention.

FIG. 3 shows a modified control structure, in which the lands or straps in the control plate 11 and in the row conductors 14 between breakthroughs lying on top of each other in the column direction, are removed. This modification has the advantage that a particularly large share of the electrons pulled into the control structure, also arrives on the phosphor layer.

The invention is not limited to the embodiments shown. Thus, the electrons could be obtained from a differently shaped gas discharge, such as a transversal plasma, or of a different type of electron source, for instance, a number of heater cathodes. Apart from this, the control unit could also be modified within relatively wide limits; in particular, it may be advisable to use still wider row conductors and/or to divide the screen electrode into strips parallel to the column conductors and to shift to horizontal electron post-deflection. Finally, it would also be conceivable to write-in the information in half-picture frames in such a manner that the individual row conductors only remain addressed for a picture line period, and the evenly-numbered and unevenly-numbered tetrode conductors are switched into conduction alternatingly during the successive half-picture periods.

The foregoing is a description conforming in substance to German application Ser. No. P 34 06 252.1, filed Feb. 21, 1984, the International priority of which is being claimed for the instant application, and which is hereby made part of this application. Any material discrepancies between the foregoing specification and the aforementioned German application are to be resolved in favor of the latter.

I claim:

1. Flat gas discharge display, comprising a gas-filled envelope having mutually parallel front and rear wall plates disposed one behind the other as seen in a given viewing direction, at least one relatively large area cathode disposed on the front side of said rear wall plate, a cathode-luminescent layer and an anode disposed on the rear side of said front wall plate, a control unit disposed between said wall plates including front, central and rear grid electrodes each formed of a group of mutually parallel strip conductors, said strip conductors of said central grid electrode being column conductors, said strip conductors of said rear grid electrode being row conductors forming an orthogonal matrix together with said column conductors, and said strip conductors of said front grid electrode being tetrode conductors extended parallel to said row conductors and crossing said column conductors at given locations, said control unit having canals formed therein at said given locations where said tetrode conductors and column conductors cross each other, said row conductors each having n adjacent rows of said canals formed therein, where n is an integer greater than one, and pairs of directly adjacent tetrode conductors disposed in front of different row conductors each forming a single strip conductor.

2. Device according to claim 1, wherein said row conductors have openings formed therein between said channels lying side by side and parallel to said column conductors.

3. Device according to claim 1, wherein lands of said row conductors are removed between said channels lying side by side and parallel to said column conductors.

4. Device according to claim 1, wherein said row conductors include $o^{th}$ row conductors each being adjacent and electrically connected to a respective one of said $n^{th}$ row conductors, where o is an integer greater than 1.

5. Device according to claim 1, wherein said row conductors include $o^{th}$ row conductors each being adjacent a respective one of said $n^{th}$ row conductors and $p^{th}$ row conductors each being adjacent a respective one of said $o^{th}$ row conductors, each tetrode conductor being adjacent and electrically connected to a respective one of said $p^{th}$ row conductors, where p is an integer greater than 1.

6. Device according to claim 1, wherein $n=2$.

7. Device according to claim 6, wherein for writing-in a picture line by line, said row conductors are keyed sequentially for two picture line periods, said column conductors are provided with corresponding picture information signals during each picture line period, and said tetrode conductors are addressed sequentially in the rhythm of said row conductor keying and are shifted by one picture line period.

* * * * *